US010605039B2

(12) United States Patent
Vasques

(10) Patent No.: US 10,605,039 B2
(45) Date of Patent: Mar. 31, 2020

(54) ANNULAR BARRIER WITH EXPANSION VERIFICATION

(71) Applicant: Welltec Oilfield Solutions AG, Zug (CH)

(72) Inventor: Ricardo Reves Vasques, Allerød (DK)

(73) Assignee: Welltec Oilfield Solutions AG, Zug (CH)

( * ) Notice: Subject to any disclaimer, the term of this patent is extended or adjusted under 35 U.S.C. 154(b) by 124 days.

(21) Appl. No.: 15/821,913

(22) Filed: Nov. 24, 2017

(65) Prior Publication Data

US 2018/0148992 A1 May 31, 2018

(30) Foreign Application Priority Data

Nov. 25, 2016 (EP) ..... 16200710

(51) Int. Cl.
*E21B 33/127* (2006.01)
*E21B 23/06* (2006.01)
(Continued)

(52) U.S. Cl.
CPC ..... *E21B 33/127* (2013.01); *E21B 23/06* (2013.01); *E21B 34/06* (2013.01); *E21B 34/103* (2013.01);
(Continued)

(58) Field of Classification Search
CPC . E21B 33/127; E21B 33/1272; E21B 33/1275
See application file for complete search history.

(56) References Cited

U.S. PATENT DOCUMENTS 2,942,667 A * 6/1960 Bridwell ..... E21B 21/00 277/333
4,260,164 A * 4/1981 Baker ..... E21B 33/127 137/461

(Continued)

FOREIGN PATENT DOCUMENTS

EP 2 642 066 9/2013
EP 3 020 912 5/2016

OTHER PUBLICATIONS

Extended EP Search Report for 16200710.8 dated Jun. 6, 2017, 8 pages.

(Continued)

*Primary Examiner* — Blake E Michener
(74) *Attorney, Agent, or Firm* — Nixon & Vanderhye P.C.

(57) ABSTRACT

The present invention relates to an annular barrier for being expanded in an annulus between a well tubular structure and a wall of a borehole or another well tubular structure downhole for isolating a first zone from a second zone in the annulus, the annulus having an annulus pressure, the annular barrier comprising: a tubular part for being mounted as part of the well tubular structure, the tubular part comprising an inside having an inside pressure, an expandable sleeve surrounding the tubular part and having an inner face facing the tubular part and an outer face facing the borehole or the wall, each end of the expandable sleeve being connected with the tubular part, an annular space between the inner face of the expandable sleeve and the tubular part, the annular space having a space pressure, and a valve system having a first system position in which fluid communication is provided between the inside of the tubular part and the annular space and a second system position in which fluid communication is provided between the annular space and the annulus, and a space fluid channel fluidly connecting the valve system with the annular space and which annular (Continued)

space in the first system position is fluidly connected with the inside of the tubular part and the annular space in the second system position is fluidly connected with the annulus, wherein the annular barrier further comprises an expansion indication unit and a chamber having a chamber pressure which is lower than a predetermined first pressure, the expansion indication unit has a first port in fluid communication with the space fluid channel, a second port in fluid communication with the chamber and a third port in fluid communication with the inside of the tubular part, the expansion indication unit has a first unit position in which the second port is fluidly disconnected from the third port and a second unit position in which the second port is fluidly connected with the third port. The present invention also relates to a downhole system and to an expansion detection method.

18 Claims, 8 Drawing Sheets

(51) Int. Cl.

| | |
|---|---|
| ***E21B 34/06*** | (2006.01) |
| ***E21B 34/10*** | (2006.01) |
| ***E21B 47/06*** | (2012.01) |
| ***E21B 43/10*** | (2006.01) |
| ***E21B 47/00*** | (2012.01) |

(52) U.S. Cl.
CPC ..... *E21B 47/00* (2013.01); *E21B 47/06* (2013.01); *E21B 33/1272* (2013.01); *E21B 33/1275* (2013.01)

(56) References Cited

U.S. PATENT DOCUMENTS

| | | | | |
|---|---|---|---|---|
| 4,299,397 | A * | 11/1981 | Baker | E21B 33/127 137/625.67 |
| 5,400,855 | A * | 3/1995 | Stepp | E21B 33/127 166/151 |
| 6,050,131 | A * | 4/2000 | Willauer | E21B 33/127 73/37 |
| 6,223,821 | B1 * | 5/2001 | Coronado | E21B 33/127 166/250.01 |
| 2003/0196820 | A1 * | 10/2003 | Patel | E21B 33/127 166/387 |
| 2010/0243234 | A1 * | 9/2010 | Saltel | E21B 23/06 166/101 |
| 2014/0216755 | A1 * | 8/2014 | Hallundæk | E21B 23/06 166/373 |
| 2015/0300154 | A1 * | 10/2015 | Hallundb K | E21B 33/127 166/250.17 |
| 2016/0053568 | A1 * | 2/2016 | Saltel | E21B 23/06 166/179 |
| 2016/0251938 | A1 * | 9/2016 | Murray | E21B 23/06 166/387 |
| 2017/0051585 | A1 * | 2/2017 | Hazel | E21B 23/01 |
| 2017/0145779 | A1 * | 5/2017 | Hazel | E21B 33/127 |
| 2017/0211347 | A1 * | 7/2017 | Vasques | E21B 33/1243 |

OTHER PUBLICATIONS

International Preliminary Report on Patentability dated May 28, 2019 in International Application No. PCT/EP2017/080303, 7 pages.

* cited by examiner

ANNULAR BARRIER WITH EXPANSION VERIFICATION

This application claims priority to EP Patent Application No. 16200710.8 filed Nov. 25, 2016, the entire contents of each of which are hereby incorporated by reference.

The present invention relates to an annular barrier for being expanded in an annulus between a well tubular structure and a wall of a borehole or another well tubular structure downhole for isolating a first zone from a second zone in the annulus. The present invention also relates to a downhole system and to an expansion detection method.

In a downhole completion, a well tubular metal structure having at least one annular barrier is arranged in the borehole for providing isolated zones in the annulus between the well tubular metal structure and the borehole. The annular barrier is expanded in the annulus downhole for isolating a first zone from a second zone. However, when expanding the annular barrier in the annulus up to several kilometres down in the ground, where many things may happen on the way down, there is a need for verifying that the annular barrier has been expanded.

It is an object of the present invention to wholly or partly overcome the above disadvantages and drawbacks of the prior art. More specifically, it is an object to provide an improved annular barrier where the expansion of the annular barrier can be verified in a simple manner.

The above objects, together with numerous other objects, advantages and features, which will become evident from the below description, are accomplished by a solution in accordance with the present invention by an annular barrier for being expanded in an annulus between a well tubular structure and a wall of a borehole or another well tubular structure downhole for isolating a first zone from a second zone in the annulus, the annulus having an annulus pressure, the annular barrier comprising:

- a tubular part for being mounted as part of the well tubular structure, the tubular part comprising an inside having an inside pressure,
- an expandable sleeve surrounding the tubular part and having an inner face facing the tubular part and an outer face facing the borehole or the wall,
- each end of the expandable sleeve being connected with the tubular part,
- an annular space between the inner face of the expandable sleeve and the tubular part, the annular space having a space pressure, and
- a valve system having a first system position in which fluid communication is provided between the inside of the tubular part and the annular space and a second system position in which fluid communication is provided between the annular space and the annulus, and
- a space fluid channel fluidly connecting the valve system with the annular space and which annular space in the first system position is fluidly connected with the inside of the tubular part and the annular space in the second system position is fluidly connected with the annulus, wherein the annular barrier further comprises an expansion indication unit and a chamber having a chamber pressure which is lower than a predetermined first pressure, the expansion indication unit has a first port in fluid communication with the space fluid channel, a second port in fluid communication with the chamber and a third port in fluid communication with the inside of the tubular part, the expansion indication unit has a first unit position in which the second port is fluidly disconnected from the third port and a second unit position in which the second port is fluidly connected with the third port.

The expansion indication unit may shift position from the first unit position to the second unit position due to the valve system shifting position from the first system position to the second system position.

The chamber of the expansion indication unit may have a pressure which is lower than the expansion pressure, and when the expansion ends and the valve system shifts position, the pressure in the space fluid channel becomes the annulus pressure which is lower than the expansion pressure in the tubular part (acting on the opposite end of the unit piston in the second bore section), and then, due to the higher pressure in the inside of the tubular part, the expansion indication unit shifts to the second unit position to provide fluid communication between the chamber and the inside of the tubular part. The expansion indication unit never brings the first port in fluid communication with either one of the second or the third ports, and thus the pressurised fluid in the space fluid channel is not hindered, neither during expansion nor during equalisation of the pressure between the annular space and the annulus after expansion. Thus, during expansion there is no movement in the expansion indication unit.

In the first system position, the fluid communication between the annulus and the space may be closed.

In the second system position, the fluid communication between the inside of the tubular part and the space may be closed.

The expansion indication unit may have a unit bore and a unit piston arranged in the bore, dividing the unit bore into a first bore section and a second bore section, the first bore section being in fluid communication with the first bore section which is in fluid communication with the first port, the second bore section being in fluid communication with the third port, the unit piston in the first unit position being arranged opposite the second port and isolating the second port from the first port and the third port.

Moreover, the expansion indication unit may further comprise a fixation means, configured to fixate the unit piston in the first unit position.

In addition, the expansion indication unit may further comprise a fixation means configured to fixate the unit piston in the first unit position until a predetermined differential pressure between the space fluid channel and the inside of the tubular part is reached.

The fixation means may be a shear pin or a burst disc.

Furthermore, the predetermined first pressure may be lower than an expansion pressure for expanding the expandable sleeve.

Also, the unit piston of the expansion indication unit may have a first piston area facing the first bore section and a second piston area facing the second bore section, the first piston area being equal to or larger than the second piston area.

Furthermore, sealing means may be arranged in grooves in the unit piston and in the first unit position sealing means may be arranged on both sides of the second port.

In addition, the chamber may have a pressure of 1 bar.

Further, the chamber may be filled with a liquid before the chamber is submerged into the borehole.

Moreover, there may be a vacuum in the chamber.

Also, the expansion indication unit may further comprise a locking mechanism configured to lock the unit piston in the second unit position.

The locking mechanism may be spring-loaded by means of a spring.

Furthermore, the third port may be arranged in a first end of the second bore section furthest away from the first port, and a distance between the third port and the second port may be smaller than a length of the unit piston.

In addition, the expandable sleeve made be of metal and thus be an expandable metal sleeve.

In addition, the valve system may comprise:

a first opening in fluid communication with the inside, a second opening in fluid communication with the annular space, a system bore having a bore extension and comprising a first bore part having a first inner diameter and a second bore part having a second inner diameter which is larger than the first inner diameter of the first bore part, wherein the first opening and the second opening are arranged in the first bore part and displaced along the bore extension, and the annular barrier further comprises:

a system piston arranged in the bore, the system piston comprising a first piston part having an outer diameter substantially corresponding to the inner diameter of the first bore part and comprising a second piston part having an outer diameter substantially corresponding to the inner diameter of the second bore part, and a rupture element preventing movement of the system piston until a predetermined second pressure in the system bore is reached.

The predetermined second pressure may be a differential pressure.

Said rupture element may be a shear pin, a shear disc, a rupture disc or similar element breakable/rupturing at a certain pressure.

The downhole annular barrier as described above may further comprise a locking element adapted to mechanically lock the system piston when the system piston is in the closed position, blocking the first opening.

Moreover, the locking element may be configured to move at least partly radially outwards or inwards upon movement of the system piston away from the initial position to prevent the system piston from returning to an initial position of the system piston.

Further, the locking element may permanently lock the system piston in a closed position.

The system piston may comprise a fluid channel being a through bore providing fluid communication between the first bore parts and the second bore parts.

Furthermore, the system piston may have a centre axis arranged in a wall of the tubular part or in a wall of a connection part connecting the expandable metal sleeve with the tubular part.

Also, the valve system may comprise a system opening which is in fluid communication with the annulus.

The system opening may be a third opening of the valve system.

Moreover, the annular barrier may comprise an anti-collapsing unit, the anti-collapsing unit having a first inlet which is in fluid communication with the first zone and a second inlet which is in fluid communication with the second zone, and the anti-collapsing unit having an outlet which is in fluid communication with the annular space through the system opening, and in a first position, the first inlet is in fluid communication with the outlet, equalising the first pressure of the first zone with the space pressure, and in a second position, the second inlet is in fluid communication with the outlet, equalising the second pressure of the second zone with the space pressure.

Further, the anti-collapsing unit may comprise an element which is movable at least between a first position and a second position.

A first one-way valve may be arranged in the first inlet, allowing fluid to flow into the anti-collapsing unit but prohibiting the fluid from flowing out of the anti-collapsing unit; a second one-way valve may be arranged in the second inlet allowing fluid to flow into the anti-collapsing unit but prohibiting the fluid from flowing out of the anti-collapsing unit.

The annular barrier as described above may further comprise a pressure sensor configured to measure the pressure in the well tubular structure in order to detect the pressure when filling the chamber.

The present invention also relates to a downhole system comprising the annular barrier as described above and further comprising a pressure creating device, such as a pump, at surface or in a submerged expansion tool.

The downhole system according to the present invention further comprises a pressure sensor configured to measure the pressure in the well tubular structure for detecting the pressure when filling the chamber.

Also, the present invention relates to an expansion detection method for verifying expansion of an annular barrier as described above, said method comprising:

applying an expansion pressure to the valve system being in the first system position to expand the sleeve, shifting from the first system position to the second system position of the valve system so that the first port is fluidly connected to the annulus pressure which is lower than the expansion pressure, allowing the unit piston to move from fluidly disconnecting the second port and the third port to fluidly connecting the second port and the third port, filling the chamber with fluid from the well tubular structure, thereby decreasing the pressure inside the well tubular structure, and detecting the decrease of the pressure in the well tubular structure by means of the pressure sensor.

The expansion detection method as described above may further comprise verifying that the annular barrier is expanded.

Also, the detection of the decrease of pressure may be a remote detection of the pressure decrease, verifying that the annular barrier is expanded.

The invention and its many advantages will be described in more detail below with reference to the accompanying schematic drawings, which for the purpose of illustration show some non-limiting embodiments and in which:

FIG. 1 shows a cross-sectional view of an annular barrier,

FIG. 2A shows a cross-sectional view of part of the annular barrier of FIG. 1 having a valve system with a system piston in an open position, FIG. 2B shows the piston of FIG. 2A in its closed position, FIG. 3A shows another embodiment of the system piston in its open position, FIG. 3B shows the piston of FIG. 3A in its closed position, FIG. 4 shows a cross-sectional view of part of the annular barrier having an expansion indication unit, FIG. 5 shows a cross-sectional view of part of another embodiment of the annular barrier, FIG. 6A shows another embodiment of the system piston in its initial position, FIG. 6B shows the piston of FIG. 6A in its closed position.

All the figures are highly schematic and not necessarily to scale, and they show only those parts which are necessary in order to elucidate the invention, other parts being omitted or merely suggested.

Figure 1:
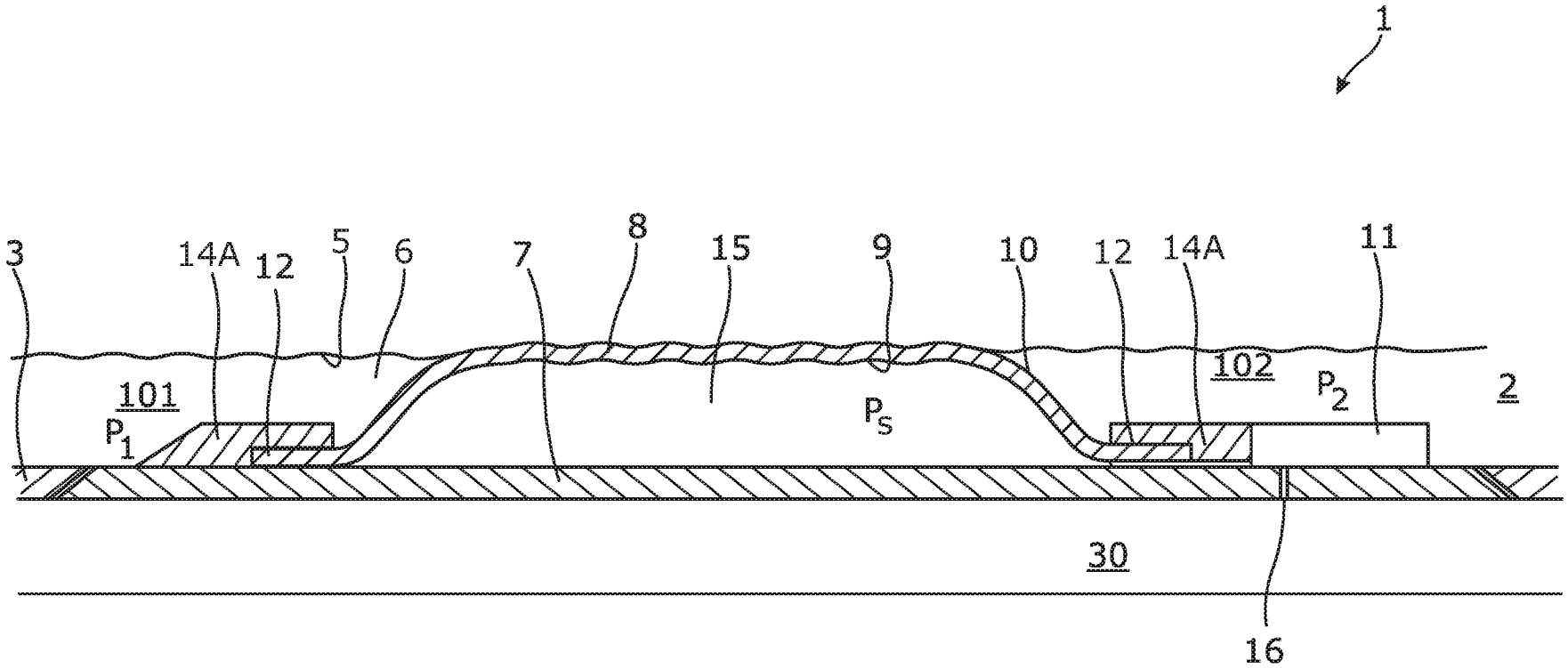

FIG. 1 shows a downhole annular barrier 1 to be expanded in an annulus 2 between a well tubular structure 3 and a wall 5 of a borehole 6 or another well tubular metal structure 3*a* (shown in FIG. 7) downhole in order to provide zone isolation between a first zone 101 having a first pressure $P_1$ and a second zone 102 having a second pressure $P_2$ of the borehole. The first pressure and the second pressure may be the same. The annular barrier 1 comprises a tubular part 7 adapted to be mounted as part of the well tubular structure 3 and having an inside being part of the inside 30 of the well tubular structure, and thus the inside of the tubular part is in fluid communication with the well tubular structure. The annular barrier 1 further comprises an expandable sleeve 8 surrounding the tubular part 7 and having an inner sleeve face 9 facing the tubular part and an outer sleeve face 10 facing the wall 5 of the borehole 6, and the outer sleeve face abuts the wall in the expanded position shown in FIG. 1. Each end 12 of the expandable sleeve 8 is connected with the tubular part 7, creating an annular space 15, having a space pressure $P_S$, between the inner sleeve face 9 of the expandable sleeve and the tubular part 7. The annular barrier 1 has a first opening 16 in fluid communication with the inside of the well tubular structure and thus the tubular part and a second opening 17 of the annular barrier are in fluid communication with the annular space 15. When the inside of the tubular part 7 is pressurised, fluid flows into the annular space 15, thereby expanding the expandable metal sleeve 8 into the expanded position, as shown in FIG. 1.

The annular barrier 1 further comprises a valve system 11 having a first system position in which fluid communication is provided between the inside of the tubular part and the annular space and a second system position in which fluid communication is provided between the annular space and the annulus. A space fluid channel 14 fluidly connects the valve system with the annular space. In the first system position, the annular space is fluidly connected with the inside of the tubular part and the fluid communication between the annulus and the space is closed. In the second system position, the annular space is fluidly connected with the annulus and the fluid communication between the inside of the tubular part and the annular space is closed. The annular barrier further comprises an expansion indication unit 50 (shown in FIG. 4) for performing an indication of whether the annular barrier is expanded or not.

Figure 4:
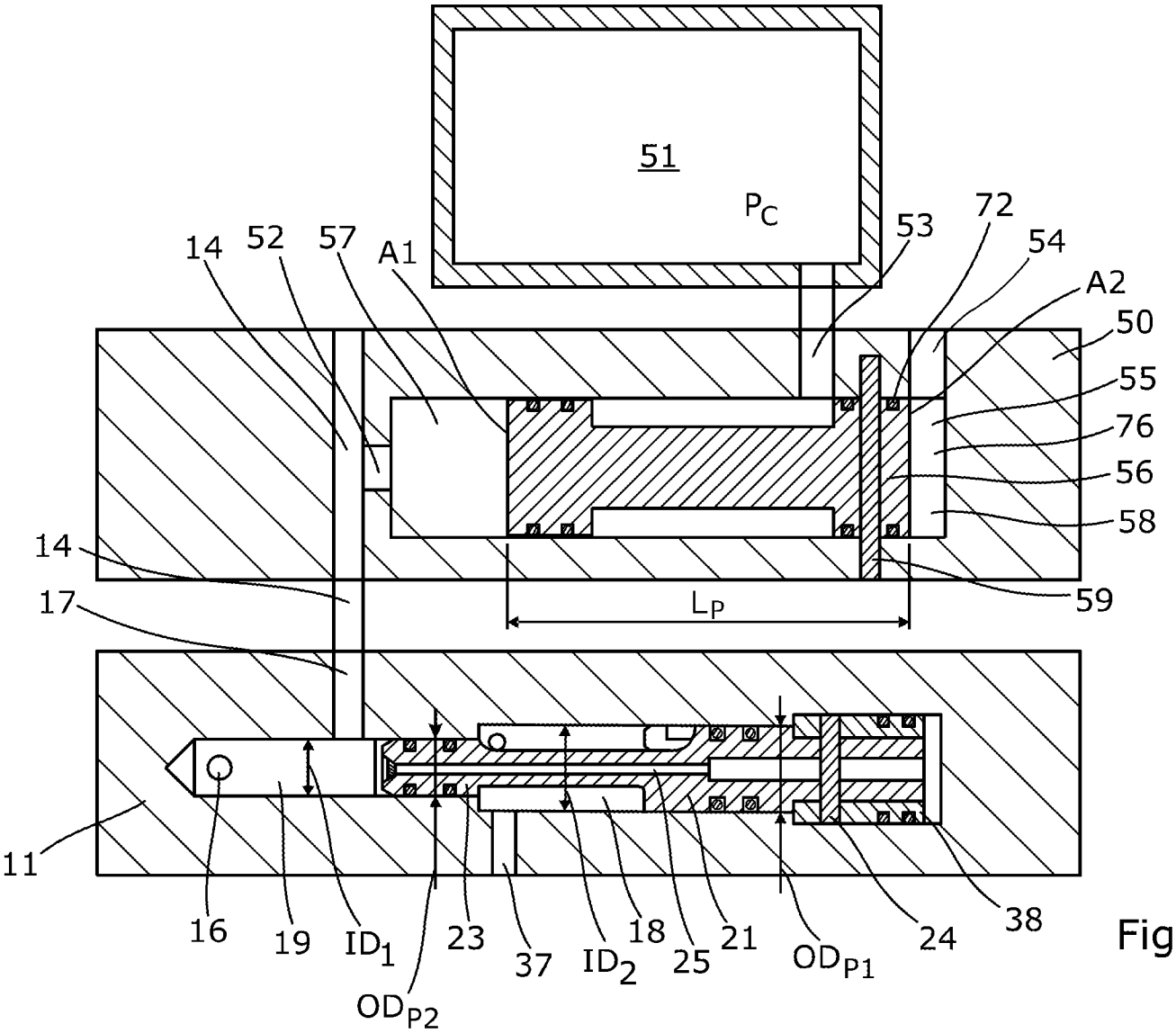
Figure 5:
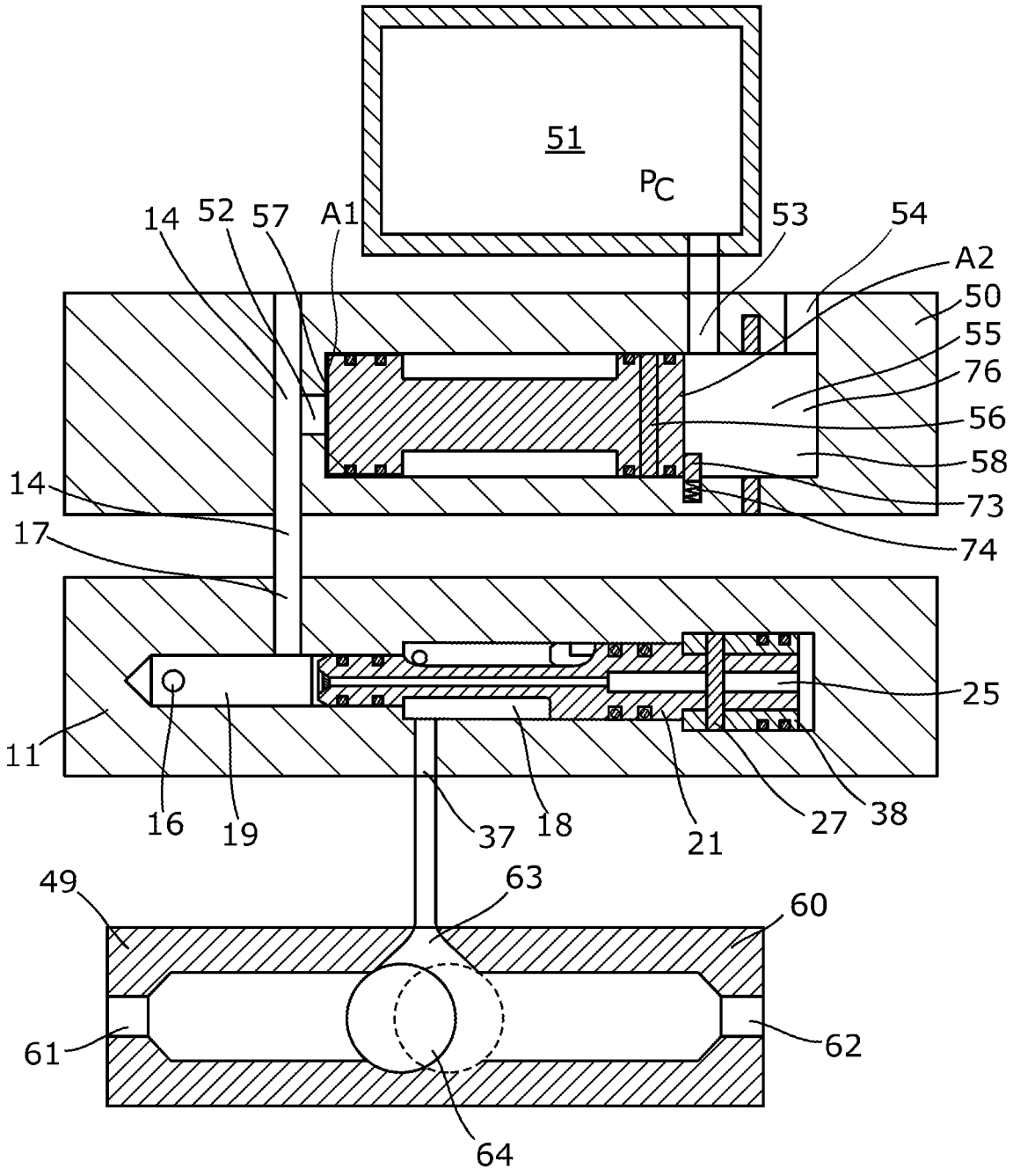

As shown in FIG. 4, the expansion indication unit comprises a chamber 51 having a chamber pressure $P_C$ which is lower than a predetermined first pressure and lower than the expansion pressure required to expand the expandable sleeve. The expansion indication unit has a first port 52 in fluid communication with the space fluid channel 14, a second port 53 in fluid communication with the chamber and a third port 54 in fluid communication with the inside of the tubular part. The expansion indication unit has a first unit position in which the second port is fluidly disconnected from the third port, as shown in FIG. 4, and a second unit position in which the second port is fluidly connected with the third port, as shown in FIG. 5.

The chamber of the expansion indication unit has a pressure which is lower than the expansion pressure, and when the expansion ends and the valve system shifts position, the pressure in the space fluid channel 14 becomes the annulus pressure which is lower than the expansion pressure in the tubular part, and then the expansion indication unit shifts to the second unit position, providing fluid communication between the chamber and the inside of the tubular part/well tubular metal structure and filling the chamber with fluid, if the chamber is not prefilled with fluid. When the chamber is filled with the fluid from the well tubular structure, the pressure in the well tubular structure drops and this pressure decrease can be detected at surface, and thus the expansion of the annular barrier can be verified at surface. The expansion of the annular barrier can thus be easily verified without having a lot of measuring devices on the outside of the expandable metal sleeve. The chamber may also be prefilled with fluid at a substantially lower chamber pressure than that of the expansion pressure.

The expansion indication unit never brings the first port in fluid communication with either one of the second or third ports, and thus the pressurised fluid in the space fluid channel is not hindered or affected, neither during expansion nor during equalisation of pressure between the annular space and the annulus after expansion. Thus, during expansion there is no movement in the expansion indication unit.

As shown in FIG. 4, the expansion indication unit has a unit bore 55 and a unit piston 56 arranged in the bore, dividing the unit bore into a first bore section 57 and a second bore section 58. The first bore section is in fluid communication with the first port, and the second bore section is in fluid communication with the third port. The unit piston is, in the first unit position, arranged opposite the second port and isolates the second port from the first port and the third port, as shown in FIG. 4. When moving from the first unit position to the second unit position, the piston moves towards the first port. In the second unit position, the unit piston is no longer opposite the second port, and brings the second port in fluid communication with the third port, as shown in FIG. 5. The unit piston 56 of the expansion indication unit has a first piston area A1 facing the first bore section and a second piston area A2 facing the second section, where the first piston area is equal to or larger than the second piston area. Sealing means 72 is arranged in grooves in the unit piston and in the first unit position sealing means is arranged on both sides of the second port.

In FIG. 5, the expansion indication unit further comprises a fixation means 59 (shown in FIG. 4), such as a shear pin, configured to fixate the piston in the first unit position. When a certain differential pressure, i.e. the predetermined differential pressure, is reached between the space fluid channel and the inside of the tubular part, the fixation means is deactivated, e.g. the shear pin is sheared.

The chamber may be filled with a gas, such as air, or liquid before being submerged into the borehole. The chamber may have a pressure of less than 300 bars, preferably less than 100 bars, more preferably less than 50 bars, even more preferably less than 5 bars. If the chamber is filled with air, the chamber may have a pressure of approximately 1 bar. There may also be a vacuum in the chamber.

In FIG. 5, the expansion indication unit further comprises a locking mechanism 73 configured to lock the unit piston 56 in the second unit position. The locking mechanism is spring-loaded by means of a spring 74. As shown in FIG. 4, the third port is arranged in a first end 76 of the second bore section furthest away from the first port 52, and a distance between the third port and the second port is smaller than a length $L_P$ of the unit piston.

In FIG. 5, the annular barrier comprises an anti-collapsing unit 60, the anti-collapsing unit having a first inlet 61 which is in fluid communication with the first zone, and a second inlet 62 which is in fluid communication with the second zone. The anti-collapsing unit has an outlet 63 which is in fluid communication with the annular space through the third opening 37, and in a first position, the first inlet is in fluid communication with the outlet, equalising the first pressure of the first zone with the space pressure, and in a second position, the second inlet is in fluid communication with the outlet, equalising the second pressure of the second zone with the space pressure. The third opening is the same as the system opening. The anti-collapsing unit comprises an element 64 which is movable at least between a first position and a second position.

Figure 2A:
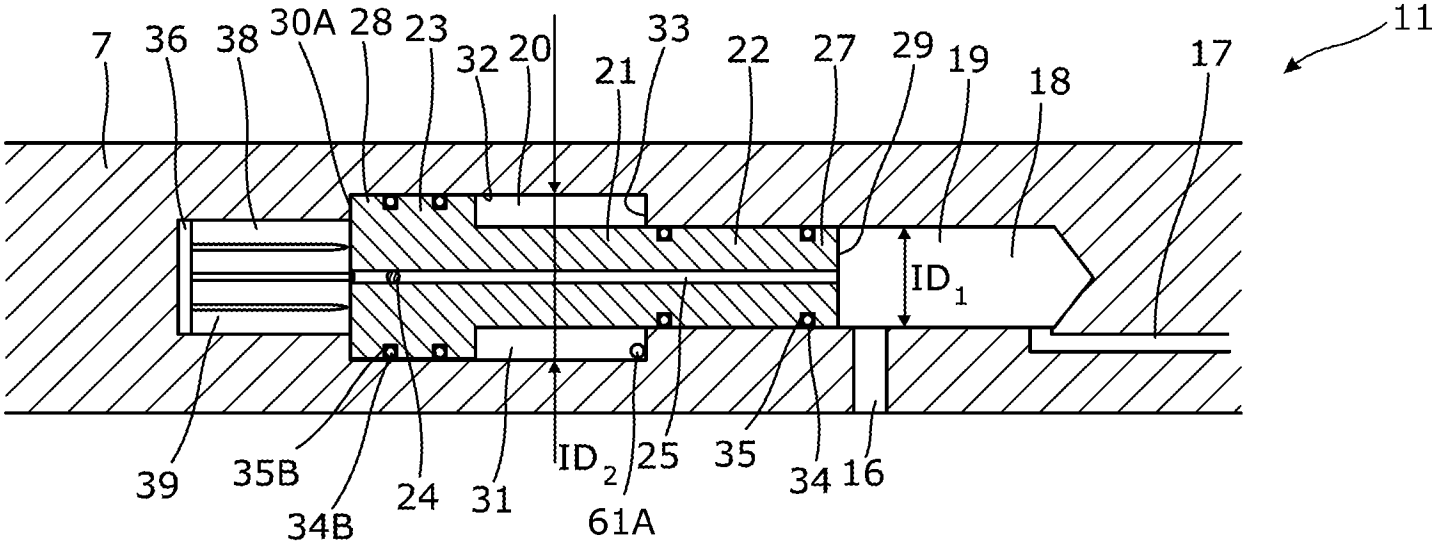

In FIG. 2A, the valve system of the annular barrier further comprises a bore 18 having a bore extension and comprising a first bore part 19 having a first inner diameter $ID_1$ and a second bore part 20 having a second inner diameter $ID_2$ which is larger than that of the first bore part. The first opening and the second opening are arranged in the first bore part 19 and are displaced along the bore extension. The valve system 11 further comprises a system piston 21 arranged in the bore 18, the piston comprising a first piston part 22 having an outer diameter $OD_{P1}$ (shown in FIG. 2B) substantially corresponding to the inner diameter of the first bore part 19, and comprising a second piston part 23 having an outer diameter $OD_{P2}$ (shown in FIG. 2B) substantially corresponding to the inner diameter of the second bore part 20. The annular barrier further comprises a rupture element 24 preventing movement of the system piston 21 until a second predetermined pressure is reached. The strength of the rupture element is set based on the pressure acting on the areas of the ends of the system piston, and thus the difference in outer diameters results in a movement of the system piston when the pressure exceeds the predetermined second pressure. The system piston 21 comprises a fluid channel 25 being a through bore providing fluid communication between the first bore part 19 and the second bore part 20.

By the valve system having a system piston 21 with a fluid channel, fluid communication between the first bore part and the second bore part is provided so that upon rupture of the rupture element, the piston can move, resulting in fluid communication with the inside of the tubular part being closed off. In this way, a simple solution without further fluid channels is provided, and due to the fact that the second piston part has an outer diameter which is larger than that of the first piston part, the surface area onto which fluid pressure is applied is larger than that of the first piston part. Thus, the pressure moves the piston when the annular barrier is expanded and pressure has been built up for breaking the rupture element 24, which allows the system piston 21 to move.

Figure 2B:
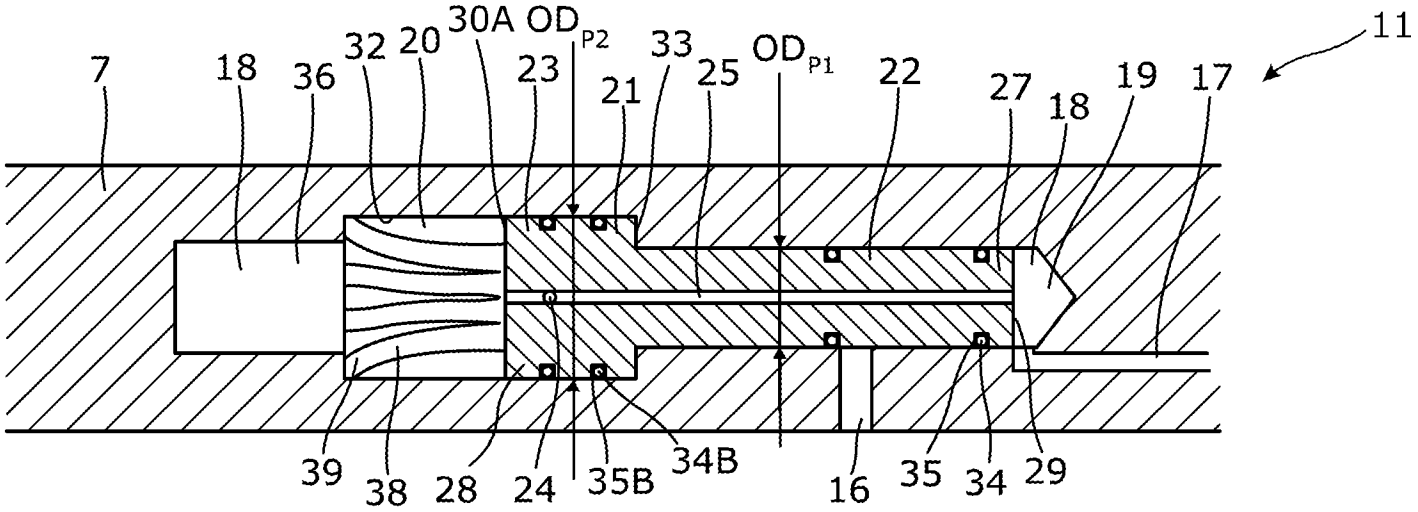
Figure 6A:
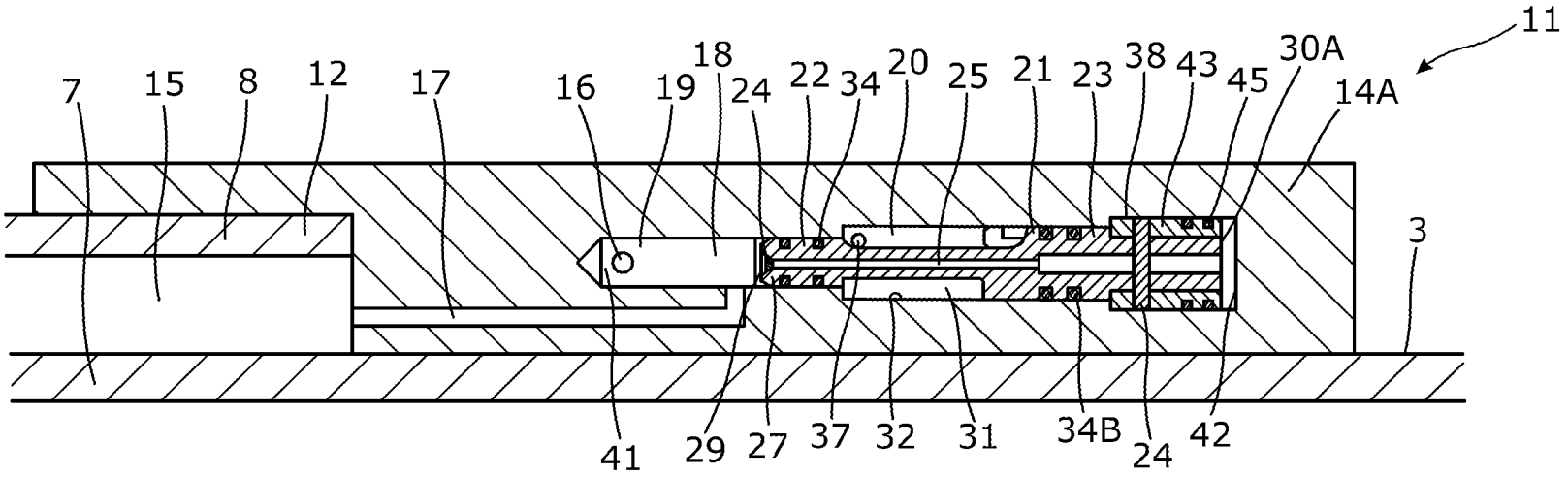
Figure 6B:
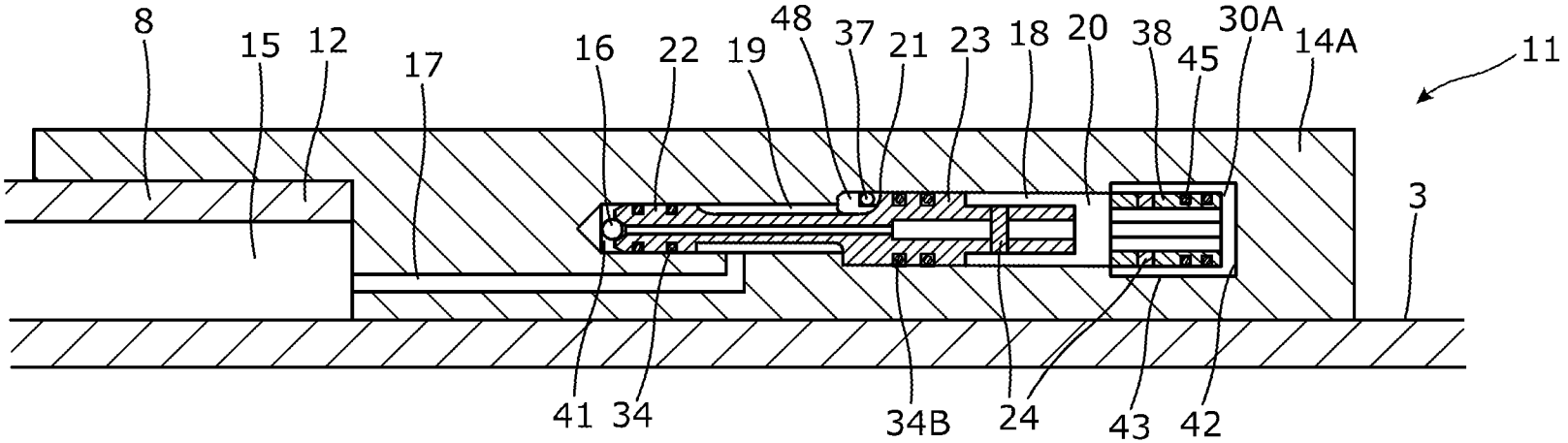

The rupture element 24 may be a shear disc, though in FIGS. 2A, 2B, 6A and 6B the rupture element is a shear pin. In FIG. 6A, the shear pin is intact and extends through the system piston 21 and the inserts 43, and in FIG. 6B, the shear pin is sheared and the system piston is allowed to move, and the inserts 43 have moved towards the centre of the bore 18. Depending on the isolation solution required to provide isolation downhole, the rupture element 24 is selected based on the expansion pressure so as to break at a pressure higher than the expansion pressure but lower than the pressure rupturing the expandable metal sleeve or jeopardising the function of other completion components downhole. In FIG. 1, the valve system with the bore and the system piston is arranged in a connection part 14A connecting the expandable metal sleeve 8 with the tubular part 7. In FIGS. 2A and 2B, the bore 18 and the system piston 21 are arranged in the tubular part 7.

In FIGS. 2A and 2B, the piston 21 of the valve system has a first piston end 27 at the first piston part 22 and a second piston end 28 at the second piston part 23, and the first piston end has a first piston face 29 and the second piston end has a second piston face 30A. Furthermore, the second piston face 30A has a face area which is larger than a face area of the first piston face 29 in order to move the system piston 21 towards the first bore part 19. The difference in face areas creates a difference in the force acting on the system piston 21, causing the piston to move to close off the fluid communication between the first opening 16 and the second opening 17.

As shown in FIG. 2A, the first piston part 22 extends partly into the second bore part 20 in an initial position of the system piston 21 and forms an annular space 31 between the piston and an inner wall 32 of the bore. The movement of the piston 21 when the fluid presses onto the second piston face 30A, stops when the second piston part 23 reaches the first bore part 19, causing the second piston part to rest against an annular face 33 created by the difference between the inner diameters of the first bore part 19 and the second bore part 20, which is shown in FIG. 2B. The annular space 31 is fluidly connected with the annulus between the well tubular structure and the inner wall of the borehole and is thus pressure-relieved via a hole 61A, thereby allowing the movement of the piston 21.

The first piston part 22 comprises two annular sealing elements 34, each arranged in an annular groove 35 in the first piston part 22. The annular sealing elements 34 are arranged at a predetermined distance and are thereby arranged at opposite sides of the first opening 16 in a closed position of the system piston 21, as shown in FIG. 2B. Furthermore, the second piston part 23 comprises two sealing elements 34B arranged in an annular groove 35B.

In FIGS. 2A and 2B, the annular barrier further comprises a locking element 38 adapted to mechanically lock the system piston 21 when the system piston is in the closed position, blocking the first opening 16, as shown in FIG. 2B.

In the known solutions, one-way valves, such as ball valves, are used for the same purpose, i.e. letting fluid into the space of the annular barrier but preventing it from escaping again. By using such check valves, the fluid inside the annular barrier is entrapped, and during e.g. fracturing of the formation where typically colder fluid is used for fracking the formation, fluid is let into the annular barrier at e.g. 300 bars which is the maximum pressure which the annular barrier is tested to withstand, without fracturing the expandable metal sleeve. When the fracking is affected using the cold fluid having a pressure of 300 bars, the annular barrier is equally filled with the cold fluid at the pressure of 300 bars. Subsequently, when the fracking has ended, the annular barrier is heated, causing the pressure in the annular barrier to increase to above the maximum pressure, since the fluid inside the annular barrier cannot escape from the annular space due to the check valve, and the expandable metal sleeve is therefore at high risk of breaking or rupturing. Thus, each time the temperature changes downhole, the pressure inside the annular barrier changes as well, and the sleeve is consequently expanded or crimped accordingly, which can result in breakage or rupture of the expandable metal sleeve. By permanently blocking the fluid communication between the annular space and the inside of the well tubular structure, the expandable metal sleeve will not undergo such large changes, which substantially reduces the risk of rupturing.

In FIG. 2A, the second piston part 23 of the valve system 11 comprises the locking element 38 arranged in the second piston end 28 of the system piston 21. The locking element 38 may be springy elements 39 projecting outwards but being suppressed in a third bore part 36 when the piston 21 is in the initial position, and the springy elements are released when the piston moves to block the first opening 16, and the springy elements thus project radially outwards, as shown in FIG. 2B. Thus, the locking element 38 is collets forming in the second piston end 28 of the system piston 21. The second bore part 20 is arranged between the first bore part 19 and the third bore part 36, and the third bore part has an inner diameter which is larger than the inner diameter of the second bore part.

When using a mechanical lock preventing backwards movement of the system piston, there is no need for a check valve to prevent the return of the system piston when the pressure inside the annular barrier increases. In this way, the risk of dirt preventing closure of the check valve and the risk that a pressure increase in the annular space of the barrier forces the system piston to return and provide fluid communication from the inside of the tubular part again, are eliminated. In the known solutions using check valves, the expandable metal sleeve has a potential risk of breaking or rupturing when the formation is fracked with colder fluid, such as seawater. By permanently blocking the fluid communication between the annular space and the inside of the well tubular structure, the expandable metal sleeve will not undergo such large changes in temperature and pressure, which substantially reduces the risk of rupturing.

Figure 3A:
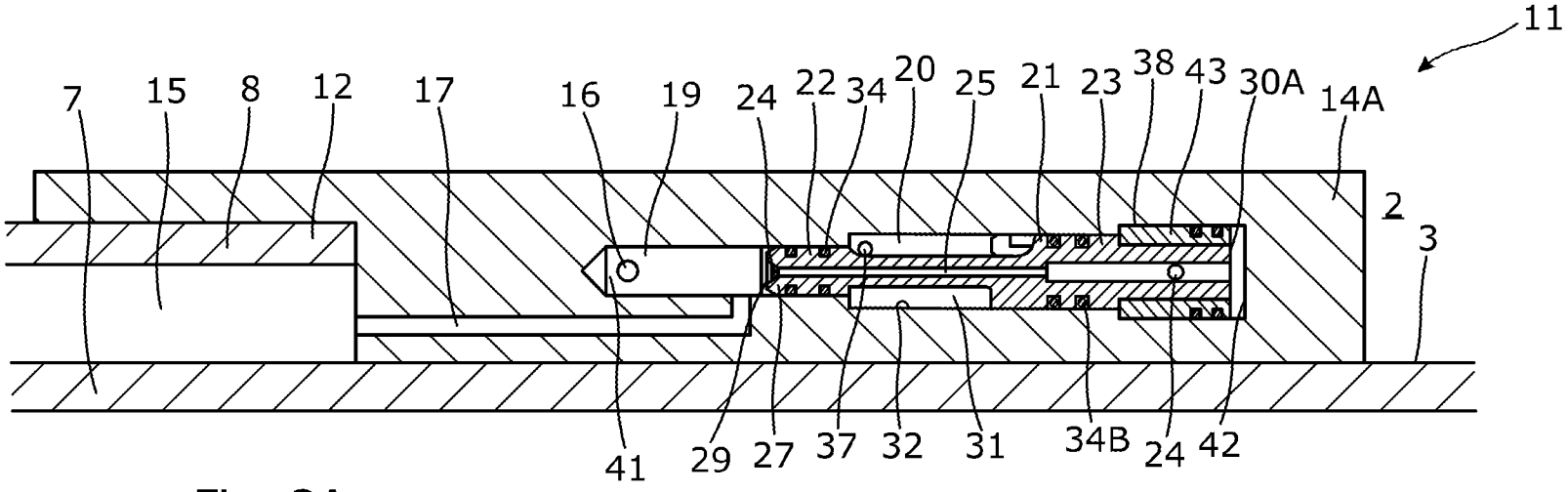

In FIG. 3A, the valve system 11 comprises a locking element 38 which is arranged around the second piston part 23. The bore further comprises a third opening/system opening 37 in the second bore part 20, which third opening is in fluid communication with the annular space 15 and the annulus 2. The third opening 37 may be arranged in fluid communication with an anti-collapsing unit 60 being a shuttle valve 49, as shown in FIG. 5, in such a way that the shuttle valve is arranged between the third opening and the annulus, thus providing fluid communication between the annular space and the annulus. The anti-collapsing unit 60 provides, in a first position, fluid communication between the annular space and the first zone 101 of the annulus (shown in FIG. 1), and in a second position, the shuttle valve provides fluid communication between the annular space and the second zone 102 of the annulus (shown in FIG. 1).

In FIG. 3A, the rupture element 24 is a shear pin arranged in the fluid channel, but in another embodiment, a shear disc may be arranged in the first bore part for preventing flow past the disc. The disc thus blocks the fluid channel or the first bore part. In FIG. 3A, the bore has a second bore end 42 in the second bore part and a first bore end 41 in the first bore part 19, and the second piston face 30A is arranged at a distance from the second bore end 42 in the initial position. In the closed position shown in FIG. 3B, the distance between the second piston face 30A and the second bore end 42 is increased.

Figure 3B:
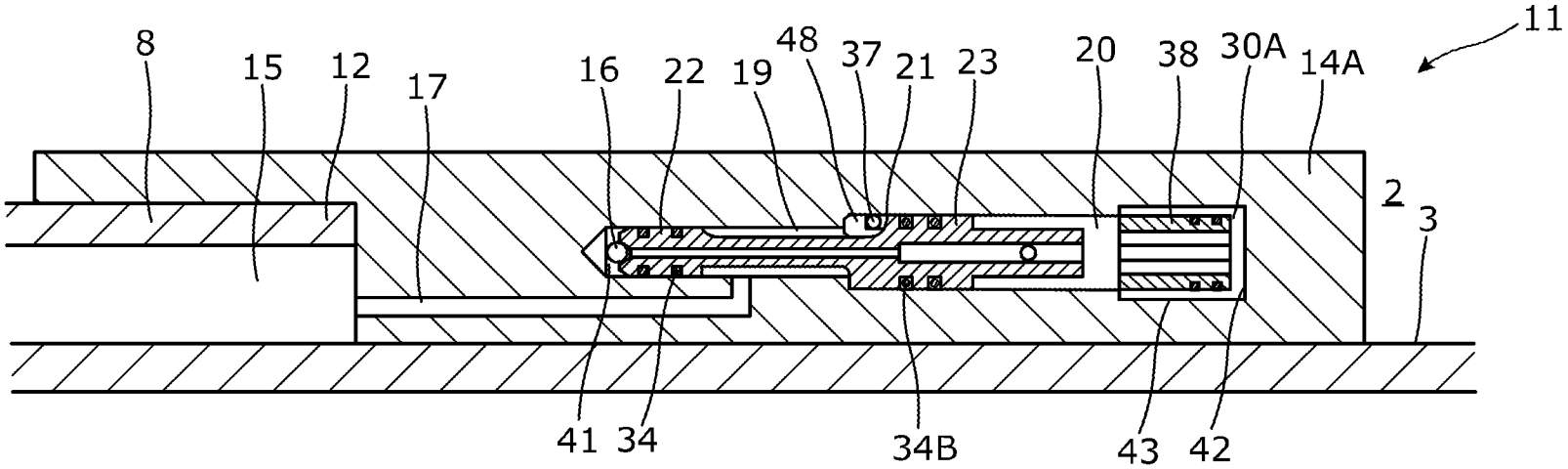

In FIGS. 3A and 3B, the locking element 38 is a plurality of inserts 43 arranged in the third bore part around the second piston end. The inserts 43 are held together by rings, such as O-rings, circlips, split rings or key rings. As the system piston 21 moves from the initial position shown in FIG. 3A to the closed position shown in FIG. 3B, the inserts 43 fall inwards and block the return of the system piston 21 and secure permanent closure of the fluid communication between the first opening 16 and the annular space 15 of the annular barrier.

Figure 8:
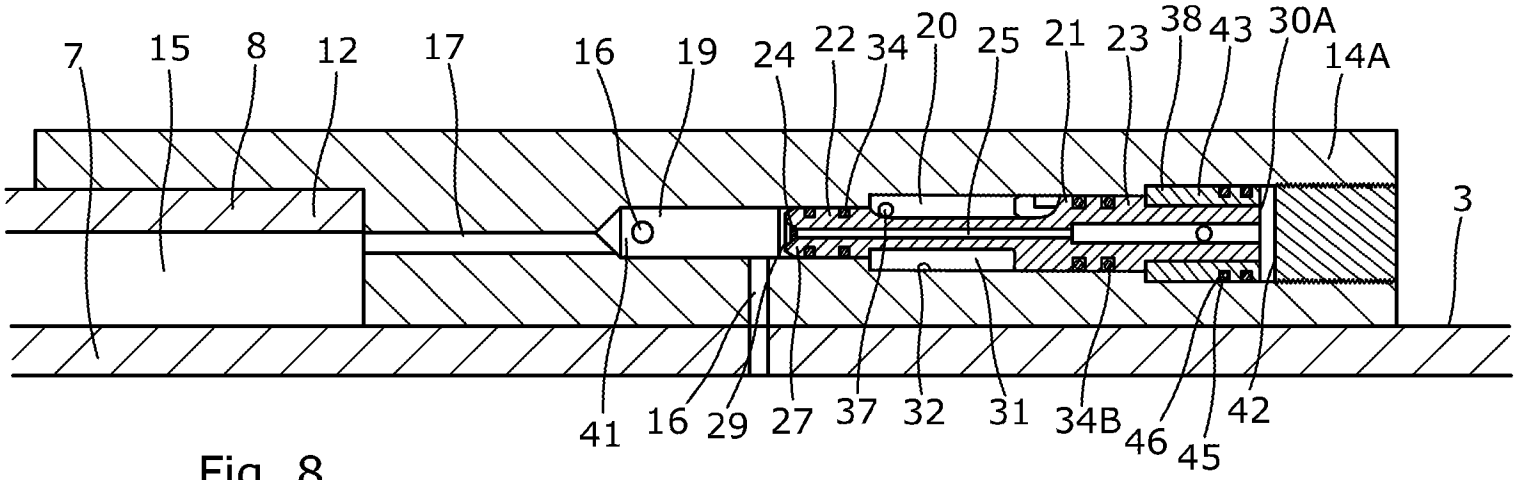
FIG. 8 shows another embodiment of the system piston in its initial position.

In FIG. 8, the locking element 38 further comprises at least one spring member 45 arranged in a circumferential groove 46 of an outer face of the inserts 43, so that the inserts are held together and forced radially inwards when the system piston 21 moves to close off for fluid communication to the inside of the tubular part 7.

Figure 9:
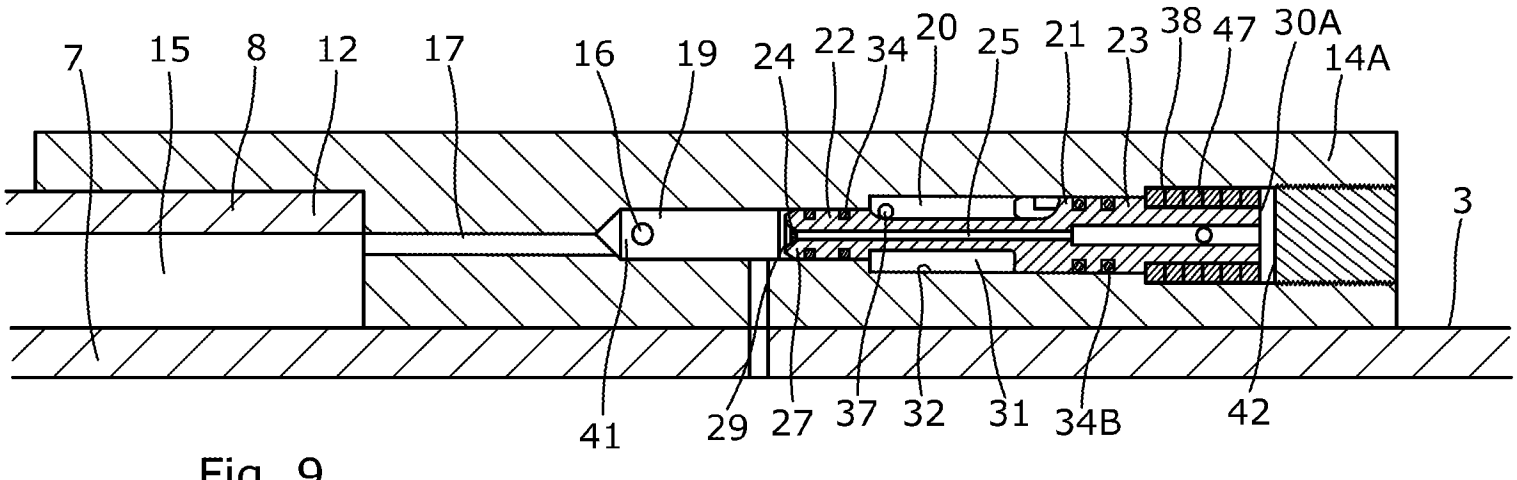
FIG. 9 shows yet another embodiment of the system piston in its initial position.

In FIG. 9, the locking element 38 is a spring member 47, such as a coiled spring, a key ring or snap rings, being expanded in the initial position, and the spring force is released when the system piston 21 moves, so that the spring member retracts to a smaller outer diameter.

Figure 7:
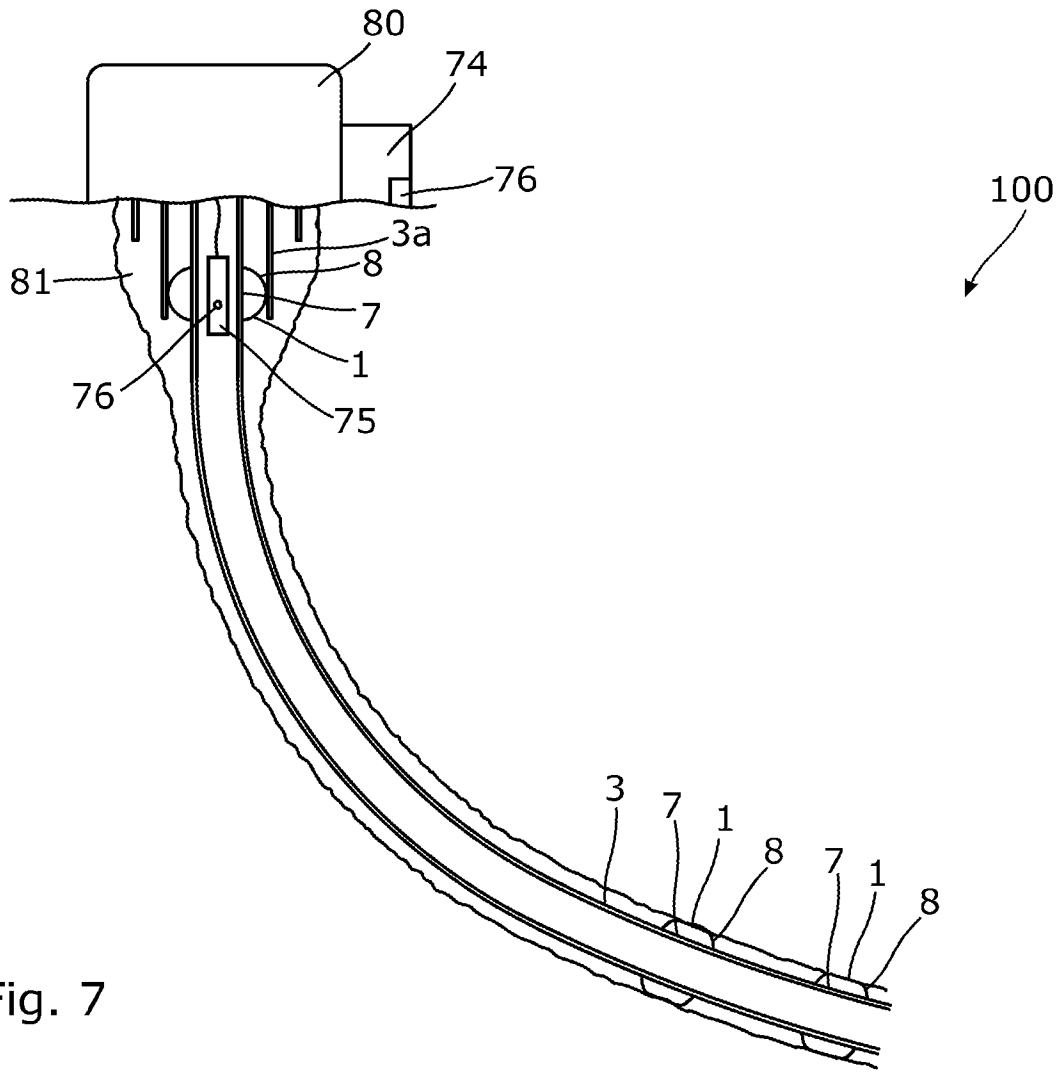
FIG. 7 shows a partly cross-sectional view of a downhole system.

In FIG. 7, the annular barrier is part of a downhole system 100 which further comprises a pressure creating device 74, such as a pump, at surface or in a submerged expansion tool 75. The downhole system further comprises a pressure sensor 76 configured to measure the pressure in the well tubular structure for detecting the pressure when filling the chamber. The pressure sensor 76 may also be comprised in the annular barrier so that the small decrease in the pressure inside the tubular metal part can be easily detected. Furthermore, in the event that several annular barriers are expanded simultaneously, a sensor arranged at each annular barrier can more easily detect the decrease in pressure from the respective annular barrier than if only one pressure sensor 76 is arranged at the well head at the top 80 of the well 81. The sensor data may then be transmitted to surface.

When having only one pressure sensor at the top of the well, the sensor detects a small pressure drop for each annular barrier which is expanded. The pressure drop is created by the low pressure, or at least a lower pressure, in the chamber as soon as fluid communication is established between the chamber and the inside of the tubular metal part/well tubular metal structure. The annular barriers may be expanded one by one with a tool or substantially simultaneously by pressurising the well tubular metal structure.

The present invention also relates to an expansion detection method for verifying expansion of an annular barrier as described above. First, in this method for verifying expansion of an annular barrier, a pressure is applied to the valve system being in the first position to expand the sleeve. Then a shift from the first position to the second position of the valve system occurs, so that the first port is fluidly connected to the annulus pressure which is lower than the expansion pressure in the tubular metal part. Hence, the unit piston 56 moves from fluidly disconnecting the second port and the third port to fluidly connecting the second port and the third port. Then, the chamber is filled with fluid from the well tubular structure, thereby decreasing the pressure inside the well tubular structure, and the decrease of the pressure in the well tubular structure is detected by means of the pressure sensor. Thus, it is verified that the annular barrier is expanded. Thus the detection of the decrease of pressure may be a remote detection of the pressure decrease, verifying that the annular barrier is expanded.

The chamber may also be pre-filled with a liquid having a low pressure in order that the pressure drop occurs as soon as fluid communication is established between the chamber and the inside of the tubular part/well tubular metal structure and the equalising of pressure between the high expansion pressure in the tubular part/well tubular metal structure is equalised with the low pressure in the chamber.

The annular barrier is thus a metal annular barrier having both an expandable sleeve made of metal and a tubular part made of metal. The annular barrier may further comprise annular sealing elements arranged in such a way that they abut and surround the expandable metal sleeve.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By an annular barrier is meant an annular barrier comprising a tubular metal part mounted as part of the well tubular metal structure and an expandable metal sleeve surrounding and connected to the tubular part defining an annular space.

By a well tubular metal structure or a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier for being expanded in an annulus between a well tubular structure and a wall of a borehole or another well tubular structure downhole for isolating a first zone from a second zone in the annulus, the annulus having an annulus pressure, the annular barrier comprising:

a tubular part for being mounted as part of the well tubular structure, the tubular part comprising an inside having an inside pressure, an expandable sleeve surrounding the tubular part and having an inner face facing the tubular part and an outer face facing the borehole or the wall, each end of the expandable sleeve being connected with the tubular part, an annular space between the inner face of the expandable sleeve and the tubular part, the annular space having a space pressure, and a valve system including a valve, the valve system being movable into a first system position in which fluid communication is provided between the inside of the tubular part and the annular space and a second system position in which fluid communication is provided between the annular space and the annulus, and a space fluid channel fluidly connecting the valve system with the annular space and which annular space in the first system position is fluidly connected with the inside of the tubular part and the annular space in the second system position is fluidly connected with the annulus, wherein the annular barrier further comprises an expansion indication unit and a chamber having a chamber pressure which is lower than a predetermined first pressure, the expansion indication unit has a first port in fluid communication with the space fluid channel, a second port in fluid communication with the chamber and a third port in fluid communication with the inside of the tubular part, the expansion indication unit has a first unit position in which the second port is fluidly disconnected from the third port and a second unit position in which the second port is fluidly connected with the third port, wherein the lower chamber pressure is detected by a drop in the tubular part inside pressure in the second unit position, thereby indicating that the expandable sleeve has been expanded.

2. The annular barrier according to claim 1, wherein the expansion indication unit shifts position from the first unit position to the second unit position due to the valve system shifting position from the first system position to the second system position.

3. The annular barrier according to claim 1, wherein the expansion indication unit has a unit bore and a unit piston arranged in the bore, dividing the unit bore into a first bore section and a second bore section, the first bore section being in fluid communication with the first port, the second bore section being in fluid communication with the third port, the unit piston in the first unit position being arranged opposite the second port and isolating the second port from the first port and the third port.

4. The annular barrier according to claim 3, wherein the unit piston of the expansion indication unit has a first piston area facing the first bore section and a second piston area facing the second bore section, the first piston area being equal to or larger than the second piston area.

5. The annular barrier according to claim 1, wherein the expansion indication unit further comprises a fixation means configured to fixate the unit piston in the first unit position.

6. The annular barrier according to claim 5, wherein the fixation means is a shear pin or a burst disc.

7. The annular barrier according to claim 4, wherein the predetermined first pressure is lower than an expansion pressure for expanding the expandable sleeve.

8. The annular barrier according to claim 1, wherein the chamber is configured to be pressurized to a pressure of 1 bar.

9. The annular barrier according to claim 1, wherein the chamber is filled with a liquid before the chamber is submerged into the borehole.

10. The annular barrier according to claim 1, wherein there is a vacuum in the chamber.

11. The annular barrier according to claim 1, wherein the expansion indication unit further comprises a locking mechanism configured to lock the unit piston in the second unit position.

12. The annular barrier according to claim 1, wherein the valve system comprises:

a first opening in fluid communication with the inside, a second opening in fluid communication with the annular space, a system bore having a bore extension and comprising a first bore part having a first inner diameter and a second bore part having a second inner diameter which is larger than the first inner diameter of the first bore part, wherein the first opening and the second opening are arranged in the first bore part and displaced along the bore extension, and the annular barrier further comprises:

a system piston arranged in the bore, the system piston comprising a first piston part having an outer diameter substantially corresponding to the inner diameter of the first bore part and comprising a second piston part having an outer diameter substantially corresponding to the inner diameter of the second bore part, and a rupture element preventing movement of the system piston until a predetermined second pressure in the system bore is reached.

13. A downhole annular barrier according to claim 1, wherein the valve system comprises a system opening which is in fluid communication with the annulus.

14. The annular barrier according to claim 1, wherein the annular barrier comprises an anti-collapsing unit, the anti-collapsing unit having a first inlet which is in fluid communication with the first zone and a second inlet which is in fluid communication with the second zone, and the anti-collapsing unit having an outlet which is in fluid communication with the annular space through the system opening, and in a first position, the first inlet is in fluid communication with the outlet, equalising the first pressure of the first zone with the space pressure, and in a second position, the second inlet is in fluid communication with the outlet, equalising the second pressure of the second zone with the space pressure.

15. The annular barrier according to claim 1, further comprising a pressure sensor configured to measure the pressure in the well tubular structure.

16. A downhole system comprising the annular barrier according to claim 1, and further comprising a pressure creating device, the pressure creating device being configured to be positioned at surface or in a submerged expansion tool.

17. The downhole system according to claim 16, further comprising a pressure sensor configured to measure the pressure in the well tubular structure.

18. An expansion detection method for verifying expansion of the annular barrier according to claim 1, said method comprising:

applying an expansion pressure to the valve system in the first system position to expand the sleeve, shifting from the first system position to the second system position of the valve system so that the first port is fluidly connected to the annulus pressure which is lower than the expansion pressure, allowing a unit piston to move from fluidly disconnecting the second port and the third port to fluidly connecting the second port and the third port, filling the chamber with fluid from the well tubular structure, thereby decreasing the pressure inside the well tubular structure, and detecting the decrease of the pressure in the well tubular structure by means of a pressure sensor, to verify expansion of the annular barrier.

* * * * *